US010140668B2

(12) United States Patent
Gopinath et al.

(10) Patent No.: US 10,140,668 B2
(45) Date of Patent: Nov. 27, 2018

(54) GIFTING ENABLED BY INTEGRATION OF COMMERCE AND SOCIAL NETWORKS

(71) Applicant: International Business Machines Corporation, Armonk, NY (US)

(72) Inventors: Divya Gopinath, Clarksburg, MD (US); Rajesh Radhakrishnan, Reston, VA (US); Jennifer A. Watson, Wasaga Beach (CA)

(73) Assignee: International Business Machines Corporation, Armonk, NY (US)

( * ) Notice: Subject to any disclaimer, the term of this patent is extended or adjusted under 35 U.S.C. 154(b) by 791 days.

(21) Appl. No.: 13/800,140

(22) Filed: Mar. 13, 2013

(65) Prior Publication Data

US 2014/0279187 A1 Sep. 18, 2014

(51) Int. Cl.
*G06Q 30/00* (2012.01)
*G06Q 50/00* (2012.01)

(52) U.S. Cl.
CPC ..... *G06Q 50/01* (2013.01)

(58) Field of Classification Search
CPC ..... G06Q 30/06–30/08
USPC ..... 705/26.1–27.2
See application file for complete search history.

(56) References Cited

U.S. PATENT DOCUMENTS

2003/0225609 A1* 12/2003 Klipfell, III ..... 705/10
2007/0168216 A1 7/2007 Lemelson
2010/0169160 A1* 7/2010 Wu et al. ..... 705/10
2012/0173333 A1 7/2012 Berger
2012/0278127 A1 11/2012 Kirakosyan et al.
2012/0323659 A1 12/2012 Konduru et al.
2012/0330772 A1 12/2012 Choe et al.
2013/0046595 A1* 2/2013 Wu et al. ..... 705/14.21

OTHER PUBLICATIONS

SeatID Ltd., Product Social Seating, 2011-2013, http://www.seatid.com/product, 2 pp.

* cited by examiner

*Primary Examiner* — Ethan D Civan
(74) *Attorney, Agent, or Firm* — Patrick J. Daugherty; Driggs, Hogg, Daugherty & Del Zoppo Co., LPA

(57) ABSTRACT

An approach to generate and execute an e-commerce gift offer for a social network contact as a function of integrating social network data into a web site offering goods or services for sale within a network computing environment is provided. In response to the user selecting an item offered for sale by the web site, aspects search personal data associated with the user that is acquired from a different, social network web site to determine an indication that another user listed within the acquired personal data has an interest in also acquiring the selected item, and present an offer to the user to select the item for an additional gift purchase for such other user as a recipient. Further aspects use the acquired personal data to narrow down retailers to those that provide delivery service to a current residence of the other user for execution of the gift purchase.

16 Claims, 3 Drawing Sheets

GIFTING ENABLED BY INTEGRATION OF COMMERCE AND SOCIAL NETWORKS

FIELD OF THE INVENTION

The present invention generally relates to automated commercial transactions enabled by integrating social networks into commerce networks within a network computing environment.

BACKGROUND

A network computing environment, which in some configurations may sometimes be referred to as a cloud computing environment, enables a plurality of different computer resources to interact cooperatively, abstracted (in some examples into a cloud layer) so that disparate devices appear to an end-user as a single pool of seamless resources. Examples of computer resources amenable to network computing or cloud environments include physical programmable devices (for example, servers, clients, etc.), storage and other memory devices, and logical computing applications and engines (for example, business and other software applications).

The Internet (or internet) is a global system of different, interconnected computer networks that use a standard Internet protocol suite (Transmission Control Protocol (TCP)/Internet Protocol (IP)) to communicate. The Internet carries an extensive range of information resources and services, such as the inter-linked hypertext documents of the World Wide Web (WWW), and a presence or participation of a given network within the internet is sometimes referred to as an "online" presence.

"Social networks" and "social networking services" generally refer to online network services, platforms, or sites that focus on serving or facilitating the building of social networks or social relations among people who shared some common attribute or interest, for example activities, professional backgrounds, families, schools or other real-life connections. Participants in a given social network generally provide personal data that they agree to share with other members of the social network, but not necessarily with other online participants not within the social network.

Electronic commerce web sites and platforms enable the exchange of goods and services via the internet or other computer networks, in some examples providing a direct connection between retailers and consumers. Consumers must generally provide to a web retailer criteria for selection of a good or service, financial account data (for example, credit card numbers, checking or debit account or other payment network account numbers), and personal identification indicia in order to successfully execute an online transaction.

BRIEF SUMMARY

In one aspect of the present invention, a method for automatically generating and executing an e-commerce gift offer for a social network contact as a function of integrating social network data includes a processing unit under direction of a user via a graphical user interface engaging a web site offering goods or services for sale within a network computing environment. In response to the user selecting an item via the graphical user interface that is offered for sale by the engaged first web site, the processing unit searches personal data associated with the first user that is acquired from a different, social network web site to determine an indication that one or more other users listed within the personal data acquired from the social network web site has an interest in acquiring the selected item. In response to determining the indication that one of the other users has an interest in acquiring the selected item, the processing unit selects the other user presenting an offer to the user to select the item for an additional gift purchase for the other user as recipient. In response to the user selecting the presented additional gift purchase for the other user, the processing unit uses personal data acquired from the social network web site to automatically determine a geographic location of a current residence of the other user, narrows down a list of online retailers offering the item to a subset of the online retailers that each also provide delivery service to the determined current residence geographic location, and selects one of the subset retailers for execution of the additional gift purchase of the item for the other user as recipient.

In another aspect of the present invention, a method provides a service for automatically generating and executing an e-commerce gift offer for a social network contact as a function of integrating social network data. The method includes integrating computer-readable program code into a computer system that has a processing unit, a computer readable memory and a computer readable tangible storage medium. The computer readable program code is embodied on the computer readable tangible storage medium and includes instructions that, when executed by the processing unit via the computer readable memory, cause the processing unit under direction of a user via a graphical user interface to engage a web site offering goods or services for sale within a network computing environment. In response to the user selecting an item via the graphical user interface that is offered for sale by the engaged first web site, the processing unit searches personal data associated with the first user that is acquired from a different, social network web site to determine an indication that one or more other users listed within the personal data acquired from the social network web site has an interest in acquiring the selected item. In response to determining the indication that one of the other users has an interest in acquiring the selected item, the processing unit selects the other user presenting an offer to the user to select the item for an additional gift purchase for the other user as recipient. In response to the user selecting the presented additional gift purchase for the other user, the processing unit uses personal data acquired from the social network web site to automatically determine a geographic location of a current residence of the other user, narrows down a list of online retailers offering the item to a subset of the online retailers that each also provide delivery service to the determined current residence geographic location, and selects one of the subset retailers for execution of the additional gift purchase of the item for the other user as recipient.

In another aspect, a system has a processing unit, computer readable memory and a tangible computer-readable storage medium with program instructions, wherein the processing unit, when executing the stored program instructions, under direction of a user via a graphical user interface engages a web site offering goods or services for sale within a network computing environment. In response to the user selecting an item via the graphical user interface that is offered for sale by the engaged first web site, the processing unit searches personal data associated with the first user that is acquired from a different, social network web site to determine an indication that one or more other users listed within the personal data acquired from the social network web site has an interest in acquiring the selected item. In response to determining the indication that one of the other users has an interest in acquiring the selected item, the processing unit selects the other user presenting an offer to the user to select the item for an additional gift purchase for the other user as recipient. In response to the user selecting the presented additional gift purchase for the other user, the processing unit uses personal data acquired from the social network web site to automatically determine a geographic location of a current residence of the other user, narrows down a list of online retailers offering the item to a subset of the online retailers that each also provide delivery service to the determined current residence geographic location, and selects one of the subset retailers for execution of the additional gift purchase of the item for the other user as recipient.

In another aspect, a computer program product has a tangible computer-readable storage medium with computer readable program code embodied therewith, the computer readable program code including instructions that, when executed by a computer processing unit, cause the computer processing unit to automatically generate and execute an e-commerce gift offer for a social network contact as a function of integrating social network data. More particularly, the processing unit under direction of a user via a graphical user interface engages a web site offering goods or services for sale within a network computing environment. In response to the user selecting an item via the graphical user interface that is offered for sale by the engaged first web site, the processing unit searches personal data associated with the first user that is acquired from a different, social network web site to determine an indication that one or more other users listed within the personal data acquired from the social network web site has an interest in acquiring the selected item. In response to determining the indication that one of the other users has an interest in acquiring the selected item, the processing unit selects the other user presenting an offer to the user to select the item for an additional gift purchase for the other user as recipient. In response to the user selecting the presented additional gift purchase for the other user, the processing unit uses personal data acquired from the social network web site to automatically determine a geographic location of a current residence of the other user, narrows down a list of online retailers offering the item to a subset of the online retailers that each also provide delivery service to the determined current residence geographic location, and selects one of the subset retailers for execution of the additional gift purchase of the item for the other user as recipient.

BRIEF DESCRIPTION OF THE SEVERAL VIEWS OF THE DRAWINGS

These and other features of this invention will be more readily understood from the following detailed description of the various aspects of the invention taken in conjunction with the accompanying drawings in which.

Figure 1:
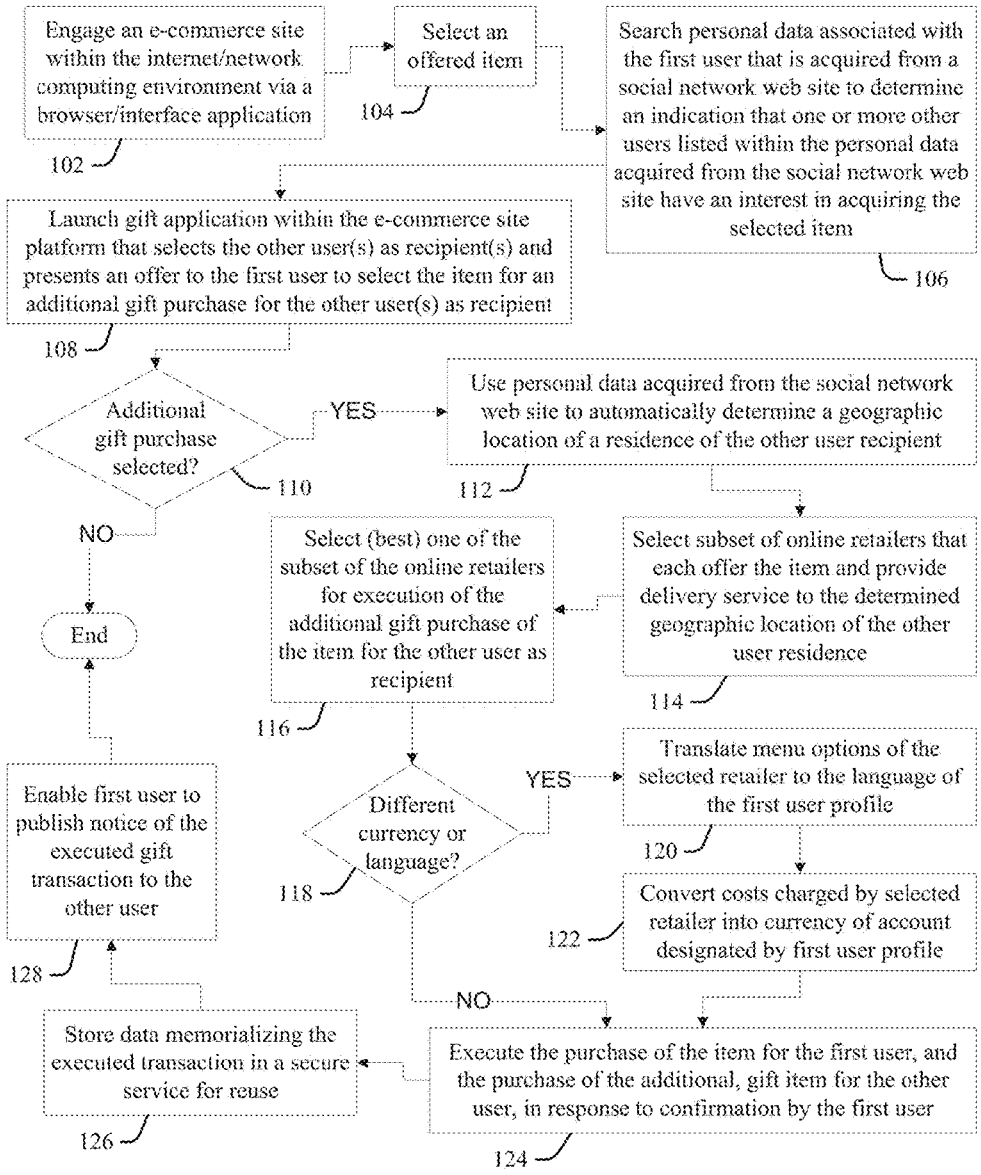
FIG. 1 is a block diagram illustration of a method, system or process according to the present invention for automatically generating and executing an e-commerce gift offer as a function of integrating social network data for a consumer.

The drawings are not necessarily to scale. The drawings are merely schematic representations, not intended to portray specific parameters of the invention. The drawings are intended to depict only typical aspects, examples and embodiments of the invention, and therefore should not be considered as limiting the scope of the invention. In the drawings, like numbering represents like elements.

DETAILED DESCRIPTION

FIG. 1 illustrates a method, system or process according to the present invention for automatically generating and executing an e-commerce gift offer for a social network contact as a function of integrating social network data. At 102 a processing unit of a computer system operated by a first user via a Graphical User Interface (GUI) engages an e-commerce web site offering goods or services for sale within the internet or other network computing environment via a browser or other interface application. An e-commerce site may also be referred to as a commerce, commercial, retail or e-tail site, and illustrative but not exhaustive examples include Amazon.com® and eBay.com®. (AMAZON.COM is a trademark, registered trademark or trade dress of Amazon in the United States and/or other countries; EBAY.COM is a trademark, registered trademark or trade dress of eBay Inc. in the United States and/or other countries.)

At 104 the first user selects via the GUI a particular item offered for sale by the engaged web site (for example, a good, service, group discount offer, etc.). Selection may be indicated by loading the item into a shopping cart within the e-commerce site for subsequent execution of purchase agreement terms to acquire the selected good or service, and still other selection criteria may be practiced in aspects of the present invention.

In response to the selection at 104, at 106 a processing unit of the e-commerce site automatically searches personal data associated with the first user that is acquired from a social network web site that is different from the e-commerce site to determine an indication that one or more other (second, third, etc.) users of the social network web site associated with the first user via the acquired personal data have an interest in acquiring the selected item. Social network site or service provides an online platform that focuses on facilitating the building of social networks or social relations among people who, for example, share interests, activities, backgrounds, or real-life connections such as familial relations. Illustrative but not exhaustive examples of social network sites include Facebook®, Google+®, and Twitter®. (FACEBOOK is a trademark, registered trademark or trade dress of Facebook, Inc. in the United States and/or other countries; GOOGLE+ is a trademark, registered trademark or trade dress of Google, Inc. in the United States and/or other countries; and TWITTER is a trademark, registered trademark or trade dress of Twitter, Inc. in the United States and/or other countries.)

In response to determining an indication that a second of such users has an interest in acquiring the selected item at 106, at 108 the e-commerce site processing unit launches a gift application within the e-commerce site platform that selects the second user as a recipient and presents an offer to the first user to select the particular item for an additional gift purchase for the second user as recipient. In some examples, the selection at 108 is a group of the other users, and the offer presented enables the first user to select each for receiving the item as a gift.

In response to the first user accepting the presented offer and selecting the item for an additional gift purchase for the second user as the recipient at 110, at 112 the gift application uses the personal data acquired from the social network web site to automatically determine a current geographic location of a current residence of the second user recipient; at 114 narrows down a list of online retailers offering the item to a subset of the online retailers that each also provide delivery service to the geographic location of the current determined second user current residence; and at 116 selects one of the subset of the online retailers for execution of the additional gift purchase of the item for the second user as the recipient. In some aspects, the selection at 116 is automatic and based on rules, for example selecting one of the subset of the online retailers that has one or more of the lowest transaction cost, the highest customer satisfaction ratings, the shortest estimated shipping time, etc., or a combination of best attributes of a plurality of ranking criteria. In some aspects, the selection at 116 may include presenting a list of the subset of the online retailers and allowing the first user to manually select one.

In some aspects of the invention, at 118 the gifting application determines if the retailer selected for the additional gift purchase uses a currency or language that is different from the currency or language of profile data of the first user. In response to a difference of language, at 120 the gifting application translates menu options of the selected retailer to the language of the first user profile and presents the translated menu options to the first user via the graphical user interface. In response to a difference in currency, at 122 the gifting application converts costs charged by the selected retailer to execute the gift item purchase for the second user into the currency of an account designated by the first user profile for purchase payments.

At 124 the gifting application executes the purchase of the item for the first user, and the purchase of the additional, gift item for the second user, in response to confirmation by the first user. Confirmation may be generated at 124 by the first user as sender browsing selections, selecting the offered gift and proceeding to checkout. In some aspects, at 126 the gifting application stores data memorializing the executed transaction in a secure service for reuse, thereby remembering the first user/sender payment options and second user profile data and enabling another, future purchase with common attributes through a "single click" buy option that populates data of the present transaction into transaction fields of the future transaction. Some aspects also enable the first user at 128 to publish gift status information of the executed transaction to the second user, for example directly on an order confirmation or delivery communication via an email or e-commerce/group discount platform, or indirectly via a posting on their common social network ("First user has just sent a gift of the item to the second user").

Figure 2:
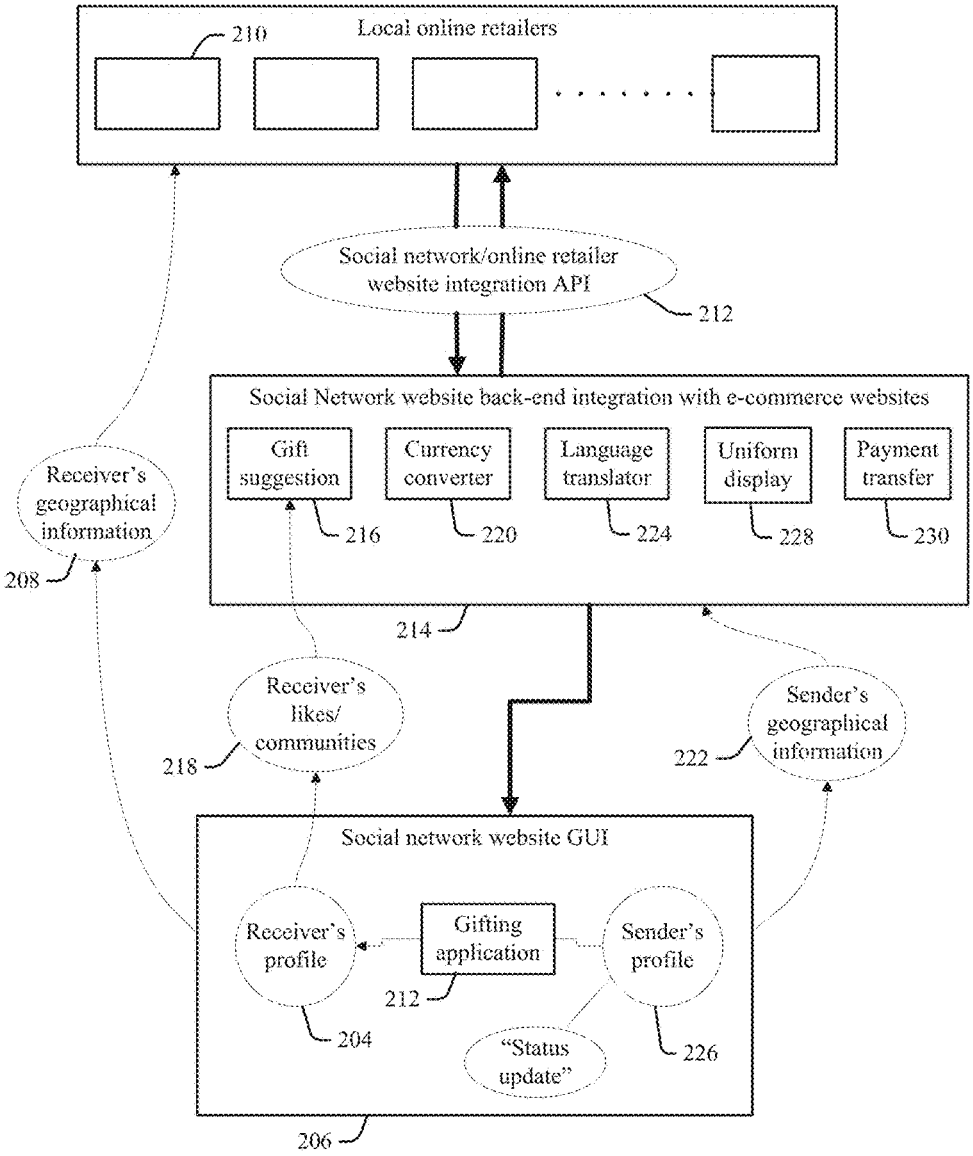
FIG. 2 is a diagram illustration of aspects of a network computing environment according to the present invention that automatically generates and executes an e-commerce gift offer as a function of integrating social network data for a consumer.

FIG. 2 illustrates an implementation of aspects of the present invention, for example as described in FIG. 1. A gift application implementation embodied by a processing unit of a computer system integrates to a social networking database to access the receiving user's profile 204 via a social network website GUI 206, in one aspect to confirm the address (geographical location) 208 of the receiving, second user for accuracy.

The websites of a plurality of different online retailers 210 (including local e-commerce retailers and group discount web sites, etc. as well as those in other countries) are communicated with via a social network/online retailer website integration Application Programming Interface (API) 212, generally a defined set of Hypertext Transfer Protocol (HTTP) request messages that includes a definition of the structure of response messages. More particularly, the gift application honors an API 212 that has a standardized protocol that integrates with the online retailer websites 210. The API 212 is generally a web-service following standard protocols, and aspects are implemented in Simple Object Access Protocol (SOAP) and Representational State Transfer (REST) style frameworks, and still other appropriate frameworks will be apparent to one skilled in the art. Online retailers 210 willing to provide their services to the social network users will have to agree to and provide their offerings via the designated or other compatible API 212. Aspects of the API 212 are flexible and able to add new online retailers 210 as they emerge.

A Social Network website back-end integration with E-commerce websites component 214 includes a Gift suggestion module 216 that is self-learning and implemented using machine-learning technologies. The Gift suggestion module 216 scans the social networking site data to determine user's likes and dislikes 218, thereby understanding gift preferences for every user, including the first/sender and second/receiver, and suggesting gift ideas for a user as a recipient, for example in response to the acquired social networking site data comprising a like for the item by the second user.

A Currency converter module 220 uses standard web or cloud-based modules to convert the currency from the selected online retailers 210 to the currency of the sender as established by the sender's geographic location data 222. A Language translator module 224 uses standard web or cloud-based modules to translate the offerings from online retailers 210 to the language that is set in the sender's profile 226, enabling the sending user to seamlessly browse through various online retailer 210 offerings in the same language, even where the online retailer 210 may be located in a different country or otherwise present offerings in a different language.

A Uniform display module 228 is implemented using sophisticated widget, web-tool kit and Asynchronous JavaScript and XML (AJAX) technologies to provide a uniform user browsing experience, irrespective of differences in national location between an online retailer 210 and the recipient's country 208. In some aspects, the Uniform display module 228 is integrated to the Gift suggestion module 216 to give the sender some recommended gift choices pursuant to budget parameters or choices of the sender.

The Payment transfer module 230 integrates with internet, network computing and cloud-based credit card services that can securely validate and accept payment. It includes built-in gates that integrate with service providers, in some aspects world-wide, to accomplish the acceptance of credit card payments across countries.

Participants in a given social network generally provide personal data that they agree to share with other members of the social network, commonly friends, family, including their birthdays, anniversary, etc. The personal data also includes demographic information such as current address, and "wall statements" and other posting and text entry activities indicating likes and dislikes, tastes and preferences providing direct and indirect marketing data and information useful for gift-giving. Such personal data is usually more extensive than the personal data provided by the user to online retailers, in some aspects to protect the privacy of the user and avoid unwanted solicitations that may be prompted by knowledge of their personal data.

However, social networks generally provide limited or no retail opportunities directly within their domain, and generally do not provide a large portfolio of gifts to choose from in order to enable a user to take advantage of any gift suggesting application opportunities that may be determined by automated applications. This separation of social networking data from the online, e-commerce domain introduces inefficiencies in gift giving with regard to time spent by end users searching for information, entering data, etc., in multiple, separate web sites. Aspects of the present invention reduce inefficiencies in time spent for the gift giving activities by integrating an end-user's social network data with e-commerce platforms that are relevant and local or otherwise useful to the gift giver and the receiving friend, family, etc., member of their common social network.

Aspects of the present invention transfer social network data, such as a friend's name, address and preferences, on a continual, periodic or as-needed basis, to a set of e-commerce gift giving platforms that provides for improved efficiencies in finding, purchasing and shipping an appropriate gift for a particular person identified in an end-user's social network. Aspects perform gift searching and suggesting automatically and in the background, without the need for the user to spend time and effort on manually initiating or directing the process, the process triggered by recognizing certain dates and events (for example, a birthday, high school graduation, etc.), identifying personal attributes (for example, female or male, age demographic (teen or in their forties) and indicated preferences (for example, they like sneakers, or bicycle equipment, etc.). Aspects eliminate the need for the user to personally enter their friend's likes and dislikes, etc., data into each of a plurality of different e-commerce web sites that may fulfill appropriate gift giving tasks. Efficiencies are also gained by eliminating the need for the use to populate each e-commerce site with their purchasing information (home address, credit card information, etc.); once provided to the gifting application, the gifting application can perform these tasks on behalf of the user multiple times to multiple different online web sites, including sites in different languages or that transact in a different currency.

Thus, when an end user browses through the pages of an e-commerce web site or group discount web site for one or more items on sale, gifting platforms according to the present invention may suggest that particular friend or relative identified via the user's social network data would like to receive the same item as a gift, for a specific occasion determined from the data (friend's birthday, etc.), as well as independent of any event or occasion. The end user is given multiple options in terms of multiple friends and relatives from his or her social network, each of which have a specific liking or preference for a specified item, or have made similar purchases before, and wherein an appropriate e-commerce site is also identified that has the capability to ship the item to the friend's address and automatically transfer all needed relevant purchasing data about the end user and his friend acquired from the social networking site to the e-commerce site. In some aspects, in response to selecting a gift from items browsed or offered the end user is automatically taken to a check out page which is pre-populated with the end user (gift sender) and friend's (gift receiver) data.

Aspects of the present invention enable an individual to identify an item of interest on an e-commerce web site or group saving website and purchase an item for a friend or relative on a separate social network site based on the friend's or relative's tastes and preference data. Efficiencies are gained by enabling an individual to purchase not only the discounted item/service or a regular e-commerce sale item for themselves, but to quickly and immediately agree to purchase the item for one or more members of his or her social network, wherein no separate shopping time and effort is required or expended.

In one example, in response to the first user viewing a $50 coupon for a certain restaurant with a certain style of cuisine that is on sale for a limited time for $25, the gifting application pops-up a list of friends who have each indicated a like or preference for the restaurant or the cuisine in (or determined from) their individual social network profile data. The list may include all the social network contacts (friends, family, associates, professional links, etc.) who meet these parameters, or only a subset of those who have higher relative preferences, for example in the case of too many hits to display.

Participating in and supporting gifting applications according to the present invention benefit e-commerce or group saving sites, in one aspect as an individual might be more likely to purchase an item or service for themselves if they are made aware that members of their social network preferred or like this particular item, for example that a friend confirms that a restaurant serves high quality food or provides good service, etc. In addition, the individual may also responsively extend their purchases to buy additional items for their social network contacts, generating more income and economic activity for the e-commerce site.

Further, some group saving site discount offers or crowdsourcing fundraising offers require that a threshold number of the offers be purchased or committed to during a specified offer period in order to honor the offer, otherwise the offer or investing or funding opportunity expires. By presenting additional offers for purchase that are tied to social network friends and relatives and other social contacts who are each likely to want to accept the gift offer, the end user is enabled to not only provide a gift that is likely to be accepted and appreciated, but also to directly improve the likelihood that the threshold of the required numbers of purchasers will be met and that the user will thereby enjoy the benefits of their own purchase.

In some aspects, items available from e-commerce and group savings websites are displayed in rankings, for example in an order of relative likelihood that they satisfy the personal preferences indicated in a friend's or relative's social network data. Individuals may tailor results displayed by making a preference to display those items related to their social network preferences first, and a secondary display of results based on those items "liked" by members of their social network.

Multiple social networks may be accessed by the gifting application, and end users may pick and choose which ones should be accessed via the gifting application by any given e-commerce or group savings website. Users may also rank different social networks, wherein the gift application searches each of the individual's social network's preferences and displays suggestions based on preferred social network status, for example listing gifting suggestions for family members in a personal social network ahead of suggestions for colleagues found in a different business, professional or school-related social network, or social network sub-grouping. Gift suggestions may also be limited for certain categories of personal items (clothing, cologne, music, etc.) to only family, or friends and family, from a personal social network, excluding contacts gleaned from business or professional networks, or sub-groupings within larger network universes.

A wide variety of security and privacy settings may be implemented by users and social network contacts. For example, the gifting application service may be restricted to search only those members of the individual's social network who are already registered with the service, and have specifically allowed the other (sending, gifting) users to capture their preferences (likes) and email information, etc., for the purposes of the gifting application.

In one example of an implementation, a first user browses a discount web site and finds a group coupon for spending a day at a local winery that is 60 miles from home, which includes lunch or dinner, free wine tasting, a day tour of the winery and an evening music concert. As the end user is about to buy the group coupon for his family of four for $90.00 (worth $270.00), the group discount web site pops up four icons of four people from his social network who have explicitly specified a liking to visiting this winery, or other wineries. In some examples, the four people are rank ordered with respect to an attribute that indicates a likelihood of enjoying or using the gift, for example by distance from their respective residences to the winery. Rank ordering may also reflect a relative preference for gifting, for example family before friends, or those with more proximate in time birthdays ahead of others; or those who have previously given the user a gift, via the gifting application or noted via other data records, may be ranked ahead of others. The user may also make a selection based on personal knowledge outside of the social network data, for example remembering that one of these four friends had treated him with generous gifts during the last holiday season, and thereby use personal knowledge to augment the automated gift suggestion rankings, to decide to return the favor by getting this friend and his family the gift of day passes for a family of four to the same winery.

Thus, gift sending is made possible directly through an e-commerce website without having the need to fetch information (manually) from the social network website. In the prior art, a user must do his or her own research to find a most suitable friend or family to send the gift to, and manually keep track of friend's likes or preferences while choosing gifts, and then determine or have knowledge of retailers who provide service in the gift receiver's geographic location. These conditions and tasks are obviated by the automatic destination location finding and matching attributes of aspects of the present invention that only display retail products that are both appropriate for their social network contacts and can be shipped to the (gift) receiver's address.

The user is also freed from the necessity of currency conversion and language translation tasks with respect to certain online retailer options, as these are taken care of by a back-end interface application. In some aspects, the user does not need to keep track of friends' address changes, as the gifting application automatically picks up a latest address from updated databases in the social network. In some examples, the social network may send updates upon entry to the gifting application.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. Examples of a computer readable storage medium exclude transitory, propagation or carrier wave signals or subject matter and include an electronic, magnetic, optical or semiconductor system, apparatus, or device, or any suitable combination of the foregoing. More specific examples (a non-exhaustive list) of the computer readable storage medium include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium is not a transitory, propagation or carrier wave signal, but instead may be any tangible medium that can contain or store a program for use by or in connection with an instruction execution system, apparatus, or device.

A computer readable signal medium may include a propagated data signal with computer readable program code embodied therein, for example, in a baseband or as part of a carrier wave. Such a propagated signal may take any of a variety of forms, including, but not limited to, electromagnetic or optical forms or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including, but not limited to, wireless, wire line, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described above with reference to flowchart illustrations and/or block diagrams of methods, apparatus (systems) and computer program products. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Figure 3:
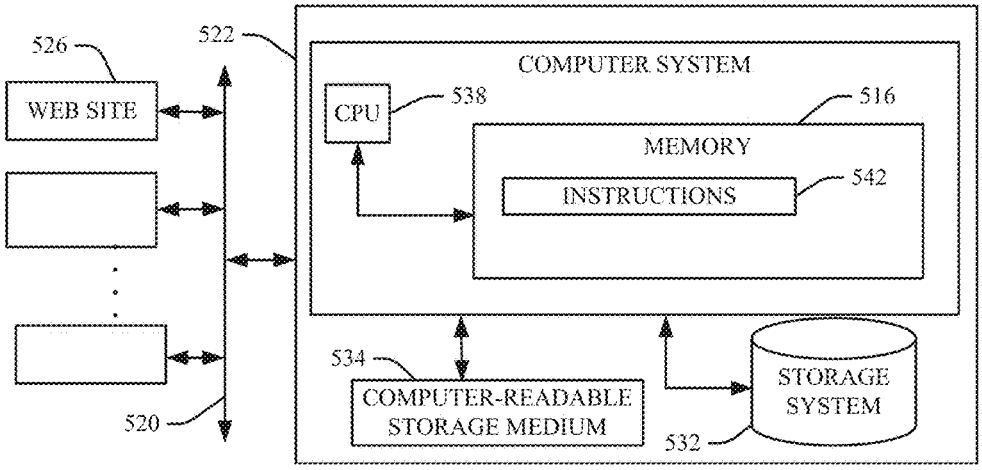
FIG. 3 is a block diagram illustration of a computer system implementation of an aspect of the present invention.

Referring now to FIG. 3, an exemplary computerized implementation of an aspect of the present invention includes a computer system or other programmable device 522 in communication with a plurality of different web sites 526 (e-commerce web sites, online retail sites, social network sites, etc.) that automatically generate and execute an e-commerce gift offer for a social network contact as a function of integrating social network data as described above with respect to FIGS. 1 and 2. Instructions 542 reside within computer readable code in a computer readable memory 516, or in a computer readable storage system 532, or other tangible computer readable storage medium 534 that is accessed through a computer network infrastructure 520 by a Central Processing Unit (CPU) 538. Thus, the instructions, when implemented by the processing unit 538, cause the processing unit 538 to perform the automated generation and execution of e-commerce gifting offers for a social network contact as a function of integrating social network data as described above with respect to FIGS. 1 and 2.

In one aspect, the present invention may also perform process steps of the invention on a subscription, advertising, and/or fee basis. That is, a service provider could offer to integrate computer-readable program code into the computer system 522 to enable the computer system 522 to perform the automated generation and execution of e-commerce gifting offers for a social network contact as a function of integrating social network data as described above with respect to FIGS. 1 and 2. The service provider can create, maintain, and support, etc., a computer infrastructure, such as the computer system 522, network environment 520, or parts thereof, that perform the process steps of the invention for one or more customers. In return, the service provider can receive payment from the customer(s) under a subscription and/or fee agreement and/or the service provider can receive payment from the sale of advertising content to one or more third parties. Services may include one or more of: (1) installing program code on a computing device, such as the computer device 522, from a tangible computer-readable medium device 532 or 534; (2) adding one or more computing devices to a computer infrastructure; and (3) incorporating and/or modifying one or more existing systems of the computer infrastructure to enable the computer infrastructure to perform the process steps of the invention.

The terminology used herein is for describing particular aspects only and is not intended to be limiting of the invention. As used herein, the singular forms "a", "an" and "the" are intended to include the plural forms as well, unless the context clearly indicates otherwise. It will be further understood that the terms "include" and "including" when used in this specification, specify the presence of stated features, integers, steps, operations, elements, and/or components, but do not preclude the presence or addition of one or more other features, integers, steps, operations, elements, components, and/or groups thereof. Certain examples and elements described in the present specification, including in the claims and as illustrated in the figures, may be distinguished or otherwise identified from others by unique adjectives (e.g. a "first" element distinguished from another "second" or "third" of a plurality of elements, a "primary" distinguished from a "secondary" one or "another" item, etc.) Such identifying adjectives are generally used to reduce confusion or uncertainty, and are not to be construed to limit the claims to any specific illustrated element or embodiment, or to imply any precedence, ordering or ranking of any claim elements, limitations or process steps.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The aspect was chosen and described in order to best explain the principles of the invention and the practical application, and to enable others of ordinary skill in the art to understand the invention for various embodiments with various modifications as are suited to the particular use contemplated.

The flowchart and block diagrams in the figures illustrate the architecture, functionality, and operation of possible implementations of systems, methods and computer program products according to various aspects of the present invention. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. A computer implemented method for automatically generating and executing an e-commerce gift offer for a social network contact as a function of integrating social network data, the method comprising executing on a processor the steps of:

in response to a first graphical interface input of a first user comprising a selection of an item that is offered for sale on a first web site that offers goods or services for sale, determining a category of the item;

searching social network personal data of the first user that is located on a social network web site that is different from the first web site to identify a plurality of other, second users that are each associated to the first user within the social network personal data of the first user, wherein the association of the second users to the first user is selected from the group consisting of a friend, a family member and a business associate of the first user;

filtering the identified plurality of second users to generate a subset of the plurality of second users that are each indicated by their respective individual social network profile data to like an item that is within the category or to have previously purchased an item within the category;

using the individual social network profile data of the subset plurality of the second users that is acquired from the social network web site to automatically determine a geographic location of a current residence of each of the subset plurality of the second users;

presenting a rank-ordered listing of offers to the first user to select the item for additional gift purchase for each of the subset plurality of second users by ranking the offers to family members ahead of friends and to friends ahead of offers to business associates of the first user, and as a function of distance from geographic locations of current residences of each of the second users to a geographic location of the item;

in response to a second graphical interface input of the first user comprising an acceptance of one of the rank-ordered listed offers, filtering a plurality of online retailers each offering the item for sale to generate a subset plurality of the online retailers that each offer the item for sale and provide for delivery of the item to the determined geographic location of the current residence of the second user that is identified in the accepted offer; and automatically selecting one of the subset plurality of the online retailers for execution of the additional gift purchase of the item for the second user that is identified in the accepted offer that has, relative to remaining others of the subset plurality of the online retailers, an attribute that is selected from the group consisting of a lowest transaction cost, a highest customer satisfaction rating, and a shortest estimated shipping time.

2. The method of claim 1, further comprising the processor executing the steps of:

in response to determining that the selected online retailer uses a language that is different from a language of profile data of the social network personal data of the first user, translating menu options of a web site of the selected online retailer to the language of the first user profile data and presenting the translated menu options to the first user via as graphical user interface; and in response to determining that the selected online retailer uses a currency that is different from a currency of a monetary account that is designated for purchases by the first user profile data, converting costs charged by the selected online retailer to execute the gift item purchase for the second user that is identified in the accepted offer into the currency of the monetary account that is designated for purchases by the first user profile data.

3. The method of claim 1, wherein the step of presenting the rank-ordered listing of offers to the first user further comprises excluding an offer to the first user to select the item for additional gift purchase for a business associate second user in response to determining that the category is a personal item category that is selected from the group consisting of clothing, cologne and music.

4. The method of claim 1, wherein the selected item is a coupon for a restaurant that is identified with a certain style of cuisine, wherein the category is the certain style of cuisine, and wherein the first user personal data indicates that the second user likes the certain style of cuisine category or has previously purchased another item within the certain style of cuisine category.

5. A method of providing a service for automatically generating and executing an e-commerce gift offer for a social network contact as a function of integrating social network data, the method comprising:

integrating computer-readable program code into a computer system comprising a processor, a computer readable memory and a computer readable tangible storage medium, wherein the computer readable program code is embodied on the computer readable tangible storage medium and comprises instructions for execution by the processor via the computer readable memory that cause the processing unit to perform steps of:

in response to a first graphical interface input of a first user comprising a selection of an item that is offered for sale on a first web site that offers goods or services for sale, determining a category of the item;

searching social network personal data of the first user that is located on a social network web site that is different from the first web site to identify a plurality of other, second users that are each associated to the first user within the social network personal data of the first user, wherein the association of the second users to the first user is selected from the group consisting of a friend, a family member and a business associate of the first user;

filtering the identified plurality of second users to generate a subset of the plurality of second users that are each indicated by their respective individual social network profile data to like an item that is within the category or to have previously purchased an item within the category;

using the individual social network profile data of the subset plurality of the second users that is acquired from the social network web site to automatically determine a geographic location of a current residence of each of the subset plurality of the second users;

presenting a rank-ordered listing of offers to the first user to select the item for additional gift purchase for each of the subset plurality of second users by ranking the offers to family members ahead of friends and to friends ahead of offers to business associates of the first user, and as a function of distance from geographic locations of current residences of each of the second users to a geographic location of the item;

in response to a second graphical interface input of the first user comprising an acceptance of one of the rank-ordered listed offers, filtering a plurality of online retailers each offering the item for sale to generate a subset plurality of the online retailers that each offer the item for sale and provide for delivery of the item to the determined geographic location of the current residence of the second user that is identified in the accepted offer; and automatically selecting one of the subset plurality of the online retailers for execution of the additional gift purchase of the item for the second user that is identified in the accepted offer that has, relative to remaining others of the subset plurality of the online retailers, an attribute that is selected from the group consisting of a lowest transaction cost, a highest customer satisfaction rating, and a shortest estimated shipping time.

6. The method of claim 5, further comprising the processor executing the program instructions stored on the tangible computer-readable storage medium via the computer readable memory and thereby:

in response to determining that the selected online retailer uses a language that is different from a language of profile data of the social network personal data of the first user, translating menu options of a web site of the selected online retailer to the language of the first user profile data and presenting the translated menu options to the first user via as graphical user interface; and in response to determining that the selected online retailer uses a currency that is different from a currency of a monetary account that is designated for purchases by the first user profile data, converting costs charged by the selected online retailer to execute the gift item purchase for the second user that is identified in the accepted offer into the currency of the monetary account that is designated for purchases by the first user profile data.

7. The method of claim 5, further comprising the processor executing the program instructions stored on the tangible computer-readable storage medium via the computer readable memory and thereby:

presenting the rank-ordered listing of offers to the first user by excluding an offer to the first user to select the item for additional gift purchase for a business associate second user in response to determining that the category is a personal item category that is selected from the group consisting of clothing, cologne and music.

8. The method of claim 5, wherein the selected item is a coupon for a restaurant that is identified with a certain style of cuisine, wherein the category is the certain style of cuisine, and wherein the first user personal data indicates that the second user likes the certain style of cuisine category or has previously purchased another item within the certain style of cuisine category.

9. A system, comprising:

a processor;

a computer readable memory in circuit communication with the processor; and a tangible computer-readable storage medium in circuit communication with the processor;

wherein the processor executes program instructions stored on the tangible computer-readable storage medium via the computer readable memory and thereby:

in response to a first graphical interface input of a first user comprising a selection of an item that is offered for sale on a first web site that offers goods or services for sale, determines a category of the item;

searches social network personal data of the first user that is located on a social network web site that is different from the first web site to identify a plurality of other, second users that are each associated to the first user within the social network personal data of the first user, wherein the association of the second users to the first user is selected from the group consisting of a friend, a family member and a business associate of the first user;

filters the identified plurality of second users to generate a subset of the plurality of second users that are each indicated by their respective individual social network profile data to like an item that is within the category or to have previously purchased an item within the category;

uses the individual social network profile data of the subset plurality of the second users that is acquired from the social network web site to automatically determine a geographic location of a current residence of each of the subset plurality of the second users;

presents a rank-ordered listing of offers to the first user to select the item for additional gift purchase for each of the subset plurality of the second users by ranking the offers to family members ahead of friends and to friends ahead of offers to business associates of the first user, and as a function of distance from geographic locations of current residences of each of the second users to a geographic location of the item;

in response to a second graphical interface input of the first user comprising an acceptance of one of the rank order listed offers, filters a plurality of online retailers each offering the item for sale to generate a subset plurality of the online retailers that each offer the item for sale and provide for delivery of the item to the determined geographic location of the current residence of the second user that is identified in the accepted offer; and automatically selects one of the subset plurality of the online retailers for execution of the additional gift purchase of the item for the second user that is identified in the accepted offer that has, relative to remaining others of the subset plurality of the online retailers, an attribute that is selected from the group consisting of a lowest transaction cost, a highest customer satisfaction rating, and a shortest estimated shipping time.

10. The system of claim 9, wherein the processor executes the program instructions stored on the computer-readable storage medium via the computer readable memory and thereby:

in response to determining that the selected online retailer uses a language that is different from a language of profile data of the social network personal data of the first user, translates menu options of a web site of the selected online retailer to the language of the first user profile data and presenting the translated menu options to the first user via as graphical user interface; and in response to determining that the selected online retailer uses a currency that is different from a currency of a monetary account that is designated for purchases by the first user profile data, converts costs charged by the selected online retailer to execute the gift item purchase for the second user that is identified in the accepted offer into the currency of the monetary account that is designated for purchases by the first user profile data.

11. The system of claim 9, wherein the processor executes the program instructions stored on the computer-readable storage medium via the computer readable memory and thereby presents the rank-ordered listing of offers to the first user by excluding an offer to the first user to select the item for additional gift purchase for a business associate second user in response to determining that the category is a personal item category that is selected from the group consisting of clothing, cologne and music.

12. The system of claim 9, wherein the selected item is a coupon for a restaurant that is identified with a certain style of cuisine, wherein the category is the certain style of cuisine, and wherein the first user personal data indicates that the second user likes the certain style of cuisine category or has previously purchased another item within the certain style of cuisine category.

13. A computer program product for automatically generating and executing an e-commerce gift offer for a social network contact as a function of integrating social network data, the computer program product comprising:

a computer readable storage medium having computer readable program code embodied therewith, wherein the computer readable storage medium is not a transitory signal per se, the computer readable program code comprising instructions for execution by a processor that causes the processor to:

in response to direction by a first user via a graphical user interface input, engage a web site offering goods or services for sale within a network computing environment;

in response to the user selecting an item via the graphical user interface that is offered for sale by the engaged first web site, search personal data associated with the first user that is located on a social network web site that is different from the engaged first web site to identify a plurality of other, second users that are each associated to the first user within the social network personal data of the first user, wherein the association of the second users to the first user is selected from the group consisting of a friend, a family member and a business associate of the first user;

filter the identified plurality of second users to generate a subset of the plurality of second users that are each indicated by their respective individual social network profile data to like an item that is within the category or to have previously purchased an item within the category use the individual social network profile data of the subset plurality of the second users acquired from the social network web site to automatically determine a geographic location of a current residence of each of the subset plurality of the second users;

present a rank-ordered listing of offers to the first user to select the item for additional gift purchase for each of the subset plurality of the second users by ranking the offers to family members ahead of friends and to friends ahead of offers to business associates of the first user, and as a function of distance from geographic locations of current residences of each of the second users to a geographic location of the item;

in response to a second graphical interface input of the first user comprising an acceptance of one of the rank order listed offers, filters a plurality of online retailers each offering the item for sale to generate a subset plurality of the online retailers that each also provide delivery service to the determined geographic location of the current residence of the second user that is identified in the accepted offer; and automatically selects one of the subset plurality of the online retailers for execution of the additional gift purchase of the item for the second user that is identified in the accepted offer that has, relative to remaining others of the subset plurality of the online retailers, an attribute that is selected from the group consisting of a lowest transaction cost, a highest customer satisfaction rating, and a shortest estimated shipping time.

14. The computer program product of claim 13, wherein the computer readable program code instructions for execution by the processor further cause the processor to:

in response to determining that the selected online retailer uses a language that is different from a language of profile data of the social network personal data of the first user, translate menu options of a web site of the selected online retailer to the language of the first user profile data and presenting the translated menu options to the first user via as graphical user interface; and in response to determining that the selected online retailer uses a currency that is different from a currency of a monetary account that is designated for purchases by the first user profile data, convert costs charged by the selected online retailer to execute the gift item purchase for the second user that is identified in the accepted offer into the currency of the monetary account that is designated for purchases by the first user profile data.

15. The computer program product of claim 13, wherein the computer readable program code instructions for execution by the processor further cause the processor to present the rank-ordered listing of offers to the first user by excluding an offer to the first user to select the item for additional gift purchase for a business associate second user in response to determining that the category is a personal item category that is selected from the group consisting of clothing, cologne and music.

16. The computer program product of claim 13, wherein the selected item is a coupon for a restaurant that is identified with a certain style of cuisine, wherein the category is the certain style of cuisine, and wherein the first user personal data indicates that the second user likes the certain style of cuisine category or has previously purchased another item within the certain style of cuisine category.

* * * * *